US005581031A

United States Patent [19]

Blankenship, Jr.

[11] Patent Number: 5,581,031

[45] Date of Patent: Dec. 3, 1996

[54] DRUM STICK PISTOL GRIPS

[76] Inventor: William E. Blankenship, Jr., 9708 W. Lake Camelot Dr., Mapleton, Ill. 61547

[21] Appl. No.: 607,759

[22] Filed: Feb. 27, 1996

[51] Int. Cl.[6] ..... G10D 13/02

[52] U.S. Cl. ..... 84/453; 84/422.4; D17/99

[58] Field of Search ..... 84/422.4, 453; D17/99; 224/217, 910

[56] References Cited

U.S. PATENT DOCUMENTS

| | | | |
|---|---|---|---|
| D. 295,872 | 5/1988 | Koumarianos | D17/22 |
| 3,365,108 | 11/1966 | Giba | 224/28 |
| 3,543,715 | 12/1970 | Hill | 84/422.4 X |
| 3,859,887 | 1/1975 | Buchanan | 84/422 |
| 3,893,364 | 7/1975 | Harrison | 84/422 |
| 5,218,152 | 6/1993 | Campbell et al. | 84/422.4 |
| 5,370,030 | 12/1994 | Horne | 84/422.4 |
| 5,447,088 | 9/1995 | Mester | 84/422.4 |

FOREIGN PATENT DOCUMENTS 107177 1/1917 United Kingdom .

*Primary Examiner*—Patrick J. Stanzione
*Attorney, Agent, or Firm*—Richard C. Litman

[57] ABSTRACT

A drumstick attachment having a hollow core dimensioned and configured to receive a drumstick. Pistol-like grips having grooves for the drummer's fingers provide a sure grip and reduce slippage due to perspiration. A ring member for the index finger enhances twirling of the stick while adding further protection from losing the stick during play. The attachment relieves stress and strain due to extended use of the drumstick. The attachment also allows the drummer to use small diameter drumsticks without the normal associated difficulties in grasping small sticks. A counterweight may be attached to the end of the drumstick, in order to keep the drumstick in equilibrium for peak performance.

7 Claims, 3 Drawing Sheets

DRUM STICK PISTOL GRIPS

BACKGROUND OF THE INVENTION

1. Field of the Invention

The present invention relates generally to a gripping aid for drumsticks. More specifically, the invention relates to an attachable pistol-type grip which slips over the drumstick and is secured thereto via fasteners.

2. Description of the Prior Art

Many drummers both professional and amateur, experience fatigue, stress and strain on the fingers, hand and wrist from extended playing. When drummers try to alleviate this problem by going to a smaller diameter drumstick they encounter difficulties in holding onto the drumsticks due to slippage caused by the smaller diameter in combination with perspiration from the hands onto the stick. In many instances the smaller stick will not produce the same sound as the bigger, heavier stick. There is therefore a need for a removable attachment to a drumstick that will reduce the stress and strain experienced by the drummer along with providing a secure, sure-handed grip of the drumstick. The present invention provides such an attachment.

Drumstick grips have been described in the patent literature. For example, U.S. Pat. No. 3,365,108 issued to Giba on Jan. 23, 1968, U.S. Pat. No. 3,859,887 issued to Buchanan on Jan. 14, 1975, and U.S. Pat. No. 5,370,030 issued to Home on Dec. 6, 1994 all describe drumstick holders having a ring dimensioned and configured to receive a finger of the drummers hand. However, none of the above patents describe a drumstick holder having a pistol-type grip with grooves that receive the fingers of the user.

U.S. Pat. No. 3,893,364 issued to Harrison on Jul. 8, 1975, and Des. 295,872 issued to Koumarianos on May 24, 1988, and United Kingdom Pat. Specification No. 107,177 published Jan. 26, 1917 all describe instrument gripping enhancement devices but do not teach or describe a pistol-type grip for drumsticks having grooves to receive the fingers of the hand and a ring to receive the index finger.

None of the above inventions and patents, taken either singly or in combination, is seen to describe the instant invention as claimed.

SUMMARY OF THE INVENTION

Accordingly, it is a principal object of the invention to provide a drumstick attachment that is removable and is attached using screw type fasteners.

It is another object of the invention to provide a drumstick attachment having indentations designed and configured to receive the fingers of a hand.

It is a further object of the invention to provide a drumstick attachment having a ring attached thereto to receive the forefinger of a hand.

Still another object of the invention is to provide a drumstick attachment having a counterweight removably attached to the drumstick.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
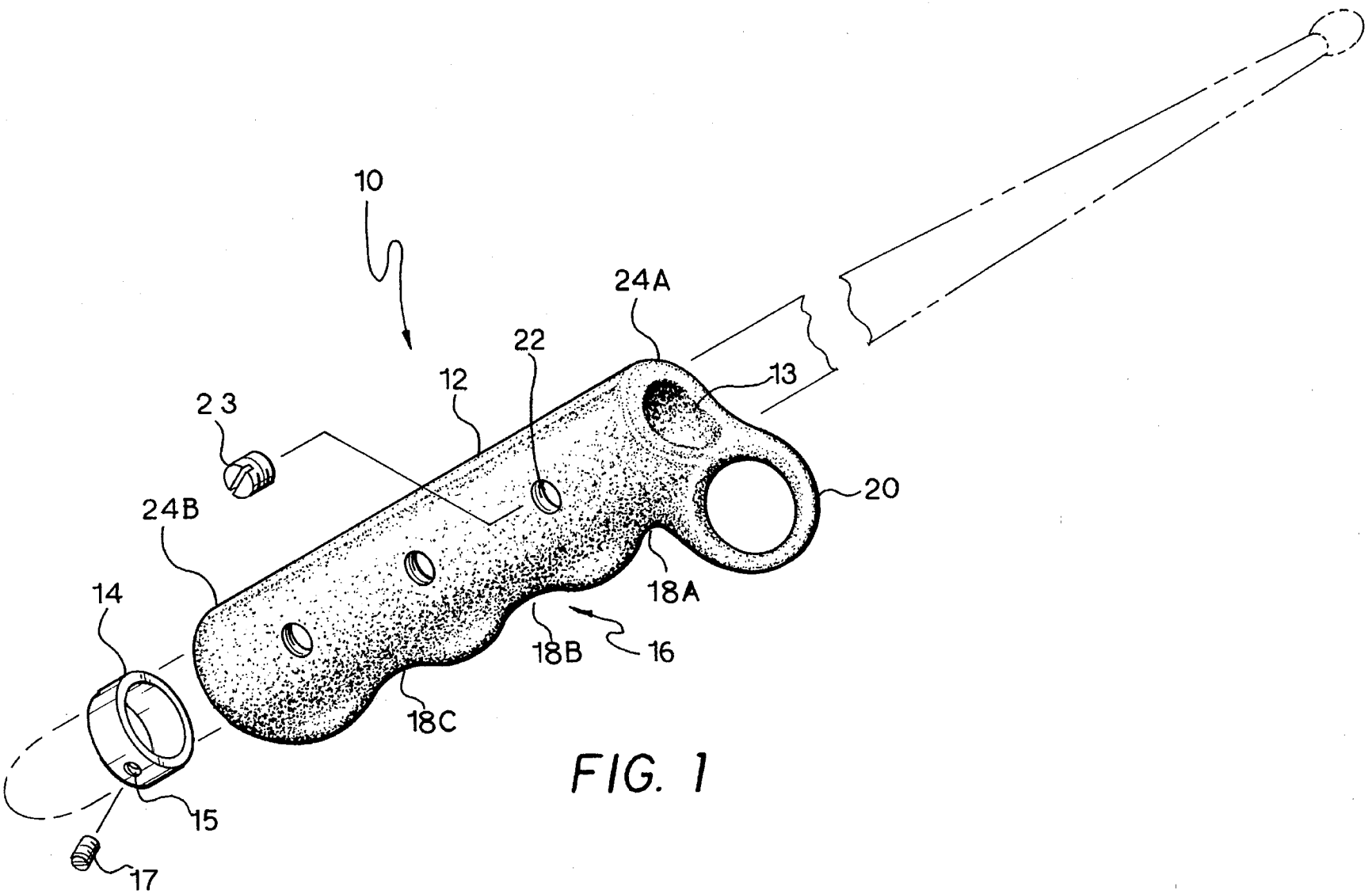
FIG. 1 is a perspective view of a preferred embodiment of the invention.

Turning now to FIG. 1 of the drawings, a drumstick attachment 10 is comprised of a main body 12 having a pistol-type grip 16. The pistol-type grip 16 has grooves 18A, 18B, and 18C therein, for receiving the middle, ring, and pinkie fingers, respectively. The thumb rests upon main body 12. Looped end or ring member 20 receives the index finger of the user. Ring member 20 assists the drummer in twirling or spinning the drumstick and reduces the possibility of dropping the drumstick. Drumstick attachment 10 is secured to the drumstick via fasteners 23 that access or engage the drumstick through holes 22. Located at the extremes of main body 12 are ends 24A and 24B, end 24B being located near the handle end of the drumstick. The drumstick attachment 10 which includes the pistol-type grip 16, grooves 18A, 18B, 18C and ring member 20 is one complete piece having a preferred material being a smooth, light-weight molded plastic. A counterweight 14 is positioned near end 24B. Counterweight 14 is dimensioned and configured to receive the drumstick and has a hole 15 to receive a fastener 17, as seen in FIG. 1. Counterweight 14 offsets the weight of attachment 10 and is made of metal.

Drumstick attachment 10 allows the drummer to grasp the drumstick easily by placing his middle, ring and pinkie fingers in grooves 18A, 18B, and 18C, respectively, while placing his index finger in ring member 20 with the thumb along main body 12. With the fingers in these positions, the drummer can grasp even the smallest diameter drumsticks, through the use of the fasteners 23, without being hindered by perspiration on the stick. The pistol-type grips allow the user to comfortably handle the sticks which reduces the occurrence of stress and strain which usually accompanies long time drum playing. The grooves 18A, 18B, 18C are smooth which permits the drummer to slide his fingers along drumstick attachment 10 in a way that enhances his drum playing. Drumstick attachment 10 has a hollow interior 13 that is dimensioned and configured to receive the drumstick.

Figure 2:
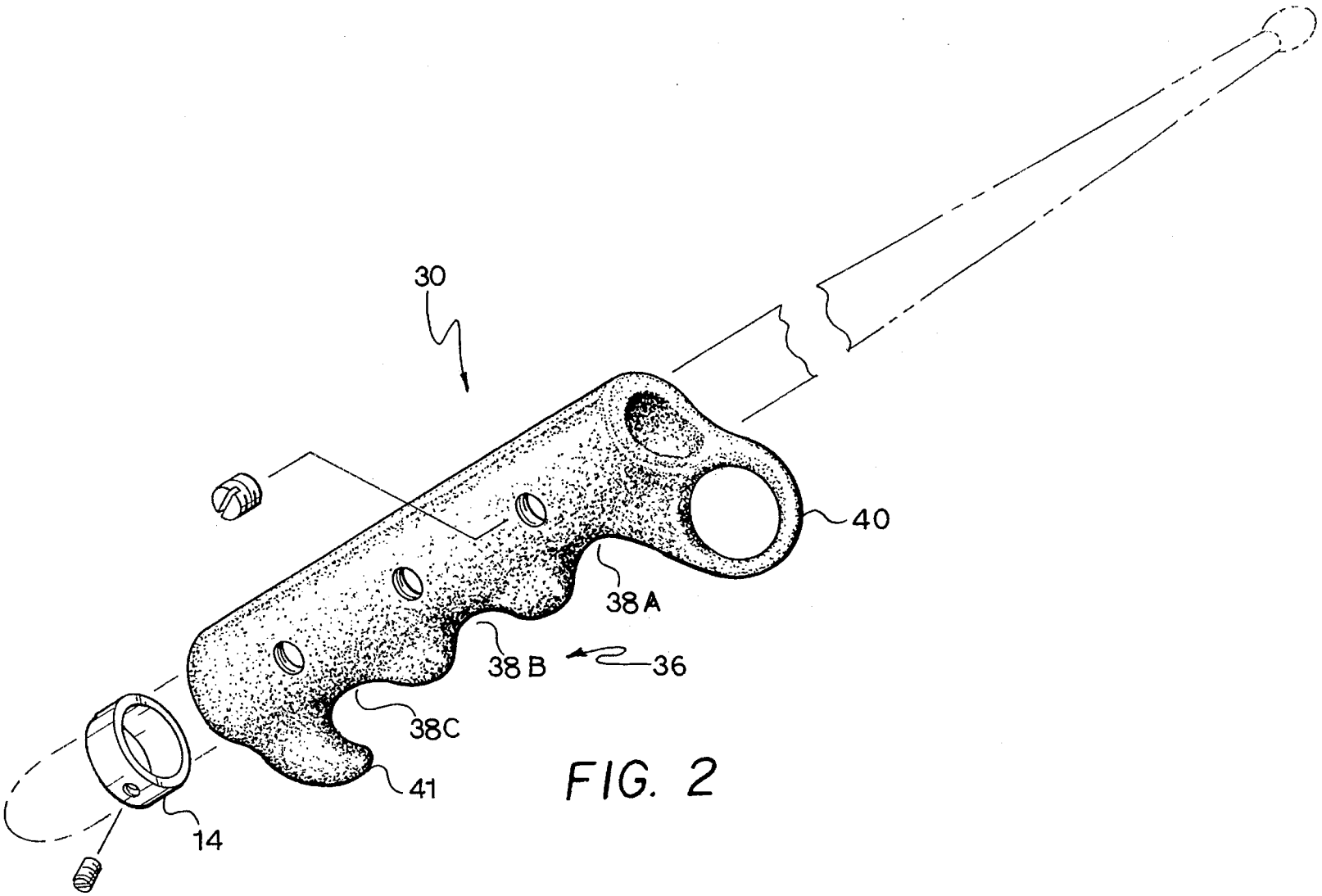
FIG. 2 is a perspective view of a second embodiment of the invention.

FIG. 2 of the drawings-shows a second embodiment of the present invention wherein drumstick attachment 30 contains a pistol-type grip 36 having finger grooves 38A, 38B, 38C that provide a comfortable grip between the fingers and a hook-like curved end 41 that aids in flipping and twirling the stick. As with the first embodiment, drumstick attachment 30 has a ring member 40 dimensioned and configured to receive the index finger and also has an optional metal counterweight 14 to balance the drumstick to assist in control and use of the drumstick. Drumstick attachment 30 preferably is made of molded plastic wherein pistol-type grip 36, finger grooves 38A, 38B, 38C and hook-like curved end 41 are all part of the one piece molded plastic construction as is drumstick attachment 10 of the first embodiment.

Figure 3:
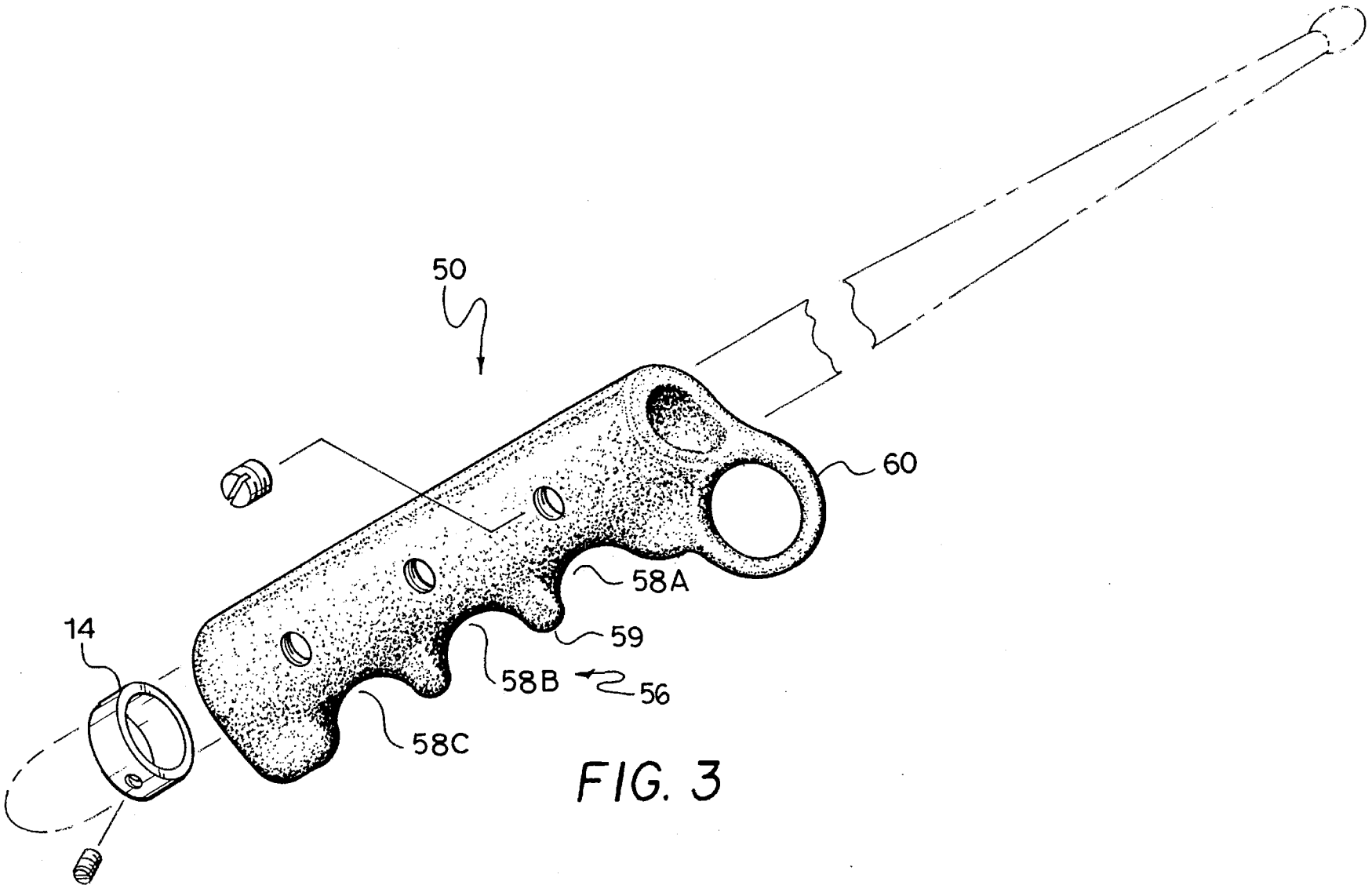
FIG. 3 is a perspective view of a third embodiment of the invention.

Turning now to FIG. 3 of the drawings shows a third embodiment of the present invention wherein drumstick attachment 50 is shown with pistol-type grip 56 having pronounced grooves 58A, 58B, 58C. The deep groves of pronounced grooves 58A, 58B, 58C along with prominent ridge 59 provide a secure grip for the drummer and hold the fingers within the grooves, therefore further reducing the chance of slippage of the sticks. In addition, ring member 60 reduces the chance of slippage of the drumstick and enhances use of the stick (e.g. drumming and twirling). Drumstick attachment 50 is constructed similarly to the drumsticks as described in the first and second embodiments. Again, as in the first two embodiments, an optional metal counterweight is used to balance the drumstick to assist in control and use of the drumstick.

It is to be understood that the present invention is not limited to the sole embodiment described above, but encompasses any and all embodiments within the scope of the following claims.

I claim:

1. An attachment for a drumstick comprising:

a main body;

a first end and a second end wherein said first and second ends abut said main body;

a pistol-type grip, said pistol-type grip further comprising a plurality of grooves and ridges dimensioned and configured to receive fingers of a drummer;

a ring member dimensioned and configured to receive an index finger of the drummer wherein said ring member is adjacent said first end, said ring member extending from said pistol-type grip;

said attachment having a hollow center dimensioned and configured to receive the drumstick therein; and means for securing said attachment to the drumstick.

2. The attachment according to claim 1, wherein said means for securing said attachment to the drumstick comprise means defining a plurality of holes in and through said main body, said holes being dimensioned and configured to receive fasteners for securing said attachment to the drumstick.

3. The attachment according to claim 2, including a counterbalance weight having a hollow center dimensioned and configured to receive the drumstick, said weight being secured in a predetermined location on the drumstick.

4. The attachment according to claim 3, wherein said counterbalance weight has means defining a hole therethrough, dimensioned and configured to receive a fastener to secure said counterbalance weight to the drumstick.

5. The attachment according to claim 3, wherein said pistol-type grip plurality of grooves and ridges have substantially smooth surfaces and ridges.

6. The attachment according to claim 3, wherein said attachment is made of plastic and has a unitary construction and wherein said counterbalance is made of metal.

7. The attachment according to claim 6, wherein said pistol-type grip further includes a hooked end located near said second end, wherein said hooked end and said ring member assist the drummer in holding onto and twirling the drumstick.

* * * * *